US005897246A

United States Patent [19]

Yamashita

[11] Patent Number: 5,897,246

[45] Date of Patent: Apr. 27, 1999

[54] MAGNET ROLL AND DEVELOPING METHOD USING THE SAME

[75] Inventor: Keitaro Yamashita, Saitama-ken, Japan

[73] Assignees: Hitachi Metals, Ltd., Tokyo; Hitachi Metals Kiko, Ltd., Gunma-Ken, both of Japan JPX

[21] Appl. No.: 08/822,867

[22] Filed: Mar. 24, 1997

[30] Foreign Application Priority Data

Mar. 29, 1996 [JP] Japan ..... 8-075731

[51] Int. Cl.[6] ..... G03G 15/09

[52] U.S. Cl. ..... 399/267; 399/270; 399/274; 399/277; 430/122

[58] Field of Search ..... 399/267, 270, 399/272, 277, 282, 285; 430/122; 492/8, 18; 335/209, 229, 296, 297, 302; 29/895

[56] References Cited

U.S. PATENT DOCUMENTS 5,384,627 1/1995 Behe et al. ..... 399/291
5,473,418 12/1995 Kazakos et al. ..... 399/284
5,541,793 7/1996 Schwarz ..... 360/121
5,565,966 10/1996 Ochiai et al. ..... 399/274
5,634,182 5/1997 Asanae et al. ..... 399/267
5,659,861 8/1997 Yamashita et al. ..... 399/267

*Primary Examiner*—Arthur T. Grimley
*Assistant Examiner*—Sophia S. Chen
*Attorney, Agent, or Firm*—Morgan, Lewis & Bockius LLP

[57] ABSTRACT

A magnet roll including a cylindrical permanent magnet having a surface thereon a plurality of magnetic poles which extend along an axis of the magnet roll and an electroconductive ceramic layer formed at least on a circumferential surface of the cylindrical permanent magnet. The electroconductive ceramic layer may be TiC, WC, TiN, TiCN, CrN, ZrN, HfN, Ti+TiN, and Cr+CrN. The magnet roll is used in a developing method of developing a latent image on a photosensitive drum by a magnetic developer while applying a bias voltage to a developing zone, in which the number of the magnetic poles (N) satisfies the relation: $N \geqq (V_1/V_2) \times \pi D/6$, wherein $V_1$ is a peripheral speed (mm/s) of the photosensitive drum, $V_2$ is a peripheral speed of the magnet roll and D is an outer diameter (mm) of the magnet roll.

13 Claims, 3 Drawing Sheets

MAGNET ROLL AND DEVELOPING METHOD USING THE SAME

BACKGROUND OF THE INVENTION

The present invention relates to a magnet roll for use in an image forming apparatus utilizing electrophotography or electrostatic recording, such as a copying machine, a printer, etc., and a developing method using the magnet roll.

The image forming apparatus conventionally used includes a copying machine, a printer, a facsimile machine, etc. In the image forming machine utilizing an electrophotographic technique or an electrostatic recording technique, the image is produced by successive steps comprising (1) forming an electrostatic latent image corresponding to the information being reproduced on a surface of a photosensitive drum (image-bearing member) by exposing the uniformly charged photosensitive surface to image light; (2) magnetically attracting a magnetic developer (one-component developer comprising a magnetic toner, or two-component developer comprising a toner and a magnetic carrier) on a rotating developer feed roll disposed closely opposing the photosensitive drum, and (3) transporting the magnetic developer to a developing zone where the electrostatic latent image on the photoconductive drum attract toner from the magnetic toner to produce toner images.

The developer feed means mainly comprises a hollow cylindrical sleeve made of non-magnetic material, a permanent magnet roll interiorly mounted in the sleeve to effectively retain the magnetic developer on the sleeve surface and transport the magnetic developer to a developing zone, a shaft supporting the rotating sleeve or permanent magnet, and a doctor blade to regulating the magnetic developer layer on the sleeve surface within a suitable thickness. The developer feed means is partially received in a housing for storing the magnetic developer, and the permanent magnet roll is located opposite to the photosensitive drum with a constant, small spacing (developing gap).

Under the recently increasing demand for improving the image quality, supplying an image forming apparatus of low cost, and reducing the size of the image forming apparatus, various proposals have been made on the developing unit which is a major part of the image forming apparatus. Of such proposals, there has been proposed a sleeve-less development where a magnetic developer is directly retained on a surface of a rotating magnet roll having no sleeve (sleeve-less magnet roll) and transported to a developing zone. For example, JP-B-54-39139 discloses a developing unit where a surface of a sleeve-less magnet roll having a electroconductive rotating shaft is covered with an electroconductive layer and a developing current is allowed to flow between an photosensitive surface and the electroconductive layer via electroconductive toners by electrically interconnecting the electroconductive layer and the rotating shaft and grounding the photosensitive surface and the rotating shaft or connecting them to a bias source. JP-A-62-201463 discloses a developing method where a developer is transported to a developing zone by retaining the developer on a rotating sleeve-less magnet roll having an electroconductive surface and a plurality of magnetic poles on the surface, and the development is conducted while applying a bias voltage including zero bias between an image-bearing member and the magnet roll.

In the conventional sleeve-less development mentioned above, the developer is necessary to be biased in the developing zone, particularly in the reverse development, to attain a high image quality with less background fogging.

Therefore, it has been proposed to coat the sleeve-less magnet roll with an electroconductive layer such as a plating layer, or make the entire body of the magnet roll electrically conductive by producing a resin-boned magnet from a material blended with an electroconductive powder. However, the proposed technique of making a plating layer involves several problems. For example, since a sintered magnet such as a ferrite sintered magnet is porous with a great number of voids, a plating solution penetrates into the magnet roll when the magnet roll is subjected to electroplating or electroless plating. The penetrated solution is difficult to be thoroughly removed from the magnet body to cause corrosion of the magnet roll. Also, the binding strength between the surface of a permanent magnet and the plating layer is usually insufficient. Further, the addition of the electroconductive powder to the material for the resin-bonded magnet reduces the magnetic force of the resultant resin-bonded magnet because the content of the ferromagnetic powder is reduced according to the addition amount of the electroconductive powder.

OBJECT AND SUMMARY OF THE INVENTION

Accordingly, an object of the present invention is to provide a magnet roll capable of being stably biased with no problem in the prior art. Another object of the present invention is to provide a developing method using such a magnet roll.

As a result of the intense research in view of the above objects, the inventors have found that the above problems in the prior art can be eliminated by making an electroconductive ceramic layer on the magnet roll by a physical vapor deposition (physical vacuum deposition), and that a high image quality can be attained by using such a magnet roll even in the sleeve-less development. The present invention has been accomplished based on the finding.

Thus, in a first aspect of the present invention, there is provided a magnet roll comprising a cylindrical permanent magnet having a surface thereon a plurality of magnetic poles which extend along an axis of the magnet roll and an electroconductive ceramic layer formed at least on a circumferential surface of the cylindrical permanent magnet.

In a second aspect of the present invention, there is provided a method of developing a latent image on a photosensitive drum by using the magnet roll while applying a bias voltage to a developing zone, in which the number of the magnetic poles (N) satisfies the following relation:

$$N \geqq (V_1/V_2) \times \pi D/6$$

wherein $V_1$ is a peripheral speed (mm/s) of the photosensitive drum, $V_2$ is a peripheral speed of the magnet roll and D is an outer diameter (mm) of the magnet roll.

DETAILED DESCRIPTION OF THE INVENTION

The cylindrical permanent magnet for the magnet roll of the present invention may be a sintered ferrite magnet, a resin-bonded magnet or a rubber magnet. Of the above magnets, the sintered ferrite magnet is most preferable because the surface of the permanent magnet is preferred to be harder in view of obtaining a highly adherent electroconductive ceramic layer, and because the permanent magnet is required to be sufficiently rigid for preventing deflection, in particular, when used in the shaft-less condition. A magnetically isotropic sintered ferrite magnet is more preferable because it can be magnetized to multi-polarity. The cylindrical permanent magnet may be hollow or solid. A radially anisotropic sintered ferrite magnet may be used as a hollow cylindrical permanent magnet.

Figure 5:
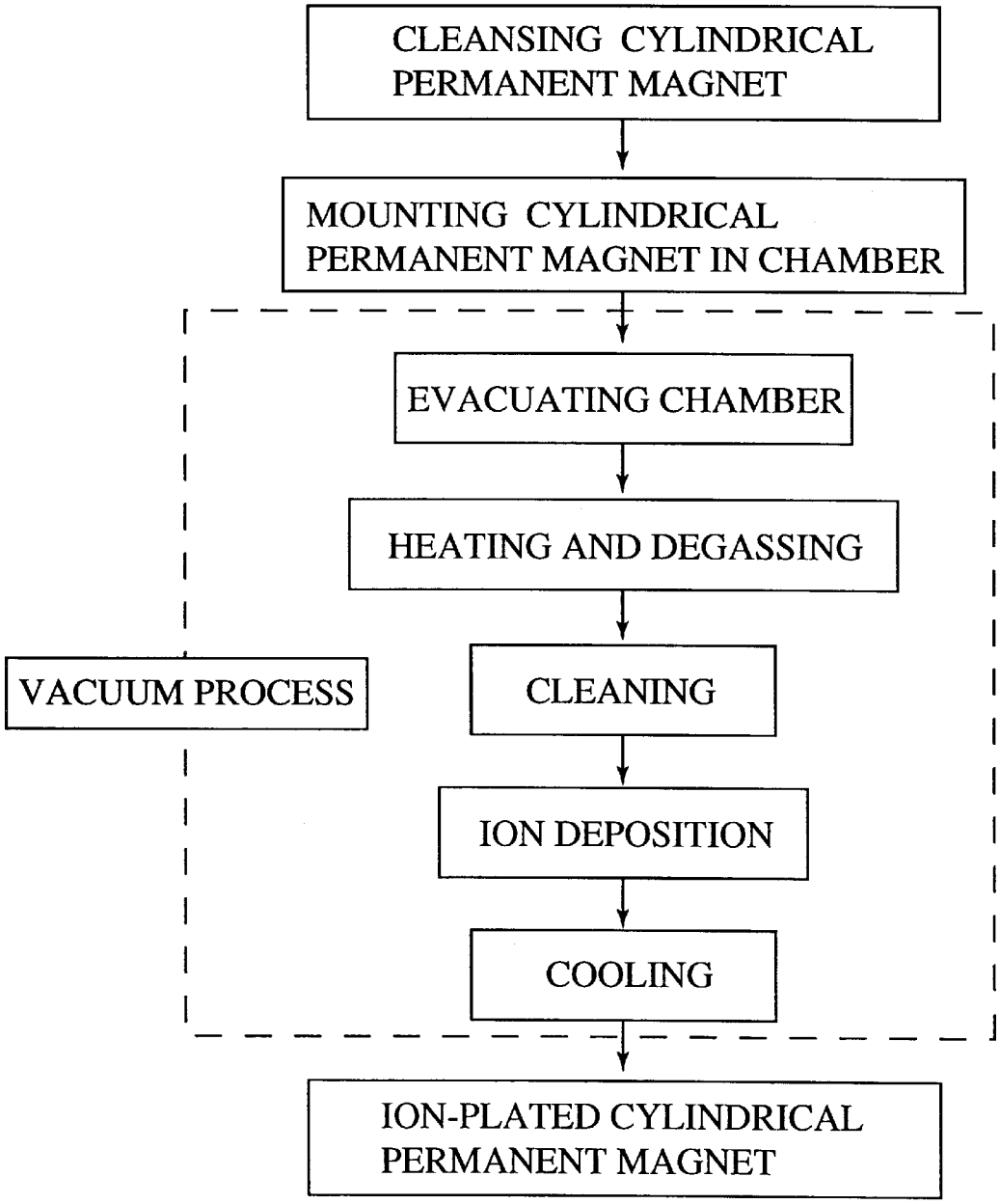
FIG. 5 is a flow chart showing the main steps of a typical ion plating method.

To attain a high image quality while preventing the background fogging, the development, particularly the reverse development, is conducted while biasing the developer in the developing zone. To effect such biasing, in the present invention, an electroconductive ceramic layer is formed on the surface of the cylindrical permanent magnet by a physical vapor deposition, preferably by an ion plating method according to sequential steps diagramatically shown in FIG. 5. The method of the ion plating is not specifically limited in the present invention, and a method known in the art may be employed. For example, a well-cleansed cylindrical permanent magnet is cathodically mounted and a vapor source is anodically mounted in a vapor deposition chamber. After evacuating the chamber, an inert gas such as Ar, He, etc. or a reactive gas such as $N_2$, $O_2$, $CH_4$, etc. is introduced to the chamber as a medium gas. The vaporized particles and the medium gas are excited and ionized by externally adding energy such as a high-frequency electric field. The ions of the vaporized particles is accelerated by the electric field toward the cylindrical permanent magnet and deposit on the surface thereof to form a thin and highly adherent electroconductive ceramic layer. Before, the deposition of the electroconductive ceramic layer, the cylindrical permanent magnet may be heated to degas the surface thereof. Also, the surface of the cylindrical permanent magnet may be cleaned or freshened by a surface vaporization prior to the deposition.

Since a thick electroconductive ceramic layer is likely to be broken, the thickness is preferably 5 $\mu$m or less, more preferably 1 to 3 $\mu$m. When the thickness is too small, the surface of the magnet is partially exposed. However, a slight exposure will not lead a disadvantageous result because the electroconductive ceramic layer is intended to assure biasing the developer in the developing zone.

The electroconductive ceramic layer is preferred to have a high hardness of 400 to 3500 Hv (Vickers hardness) and may be composed of TiC, WC, TiN, TiCN, CrN, ZrN, HfN, Ti+TiN, and Cr+CrN. The Vickers hardness is preferably 500 to 3000, more preferably 600 to 2500. In the present invention, the "electroconductive ceramic layer" means a ceramic layer having a specific electric resistivity of $1\times10^3$ $\Omega$·cm or less, preferably $1\times10^2$ $\Omega$·cm or less, and further preferably $1\times10$ $\Omega$·cm or less. Also, the electroconductive ceramic layer preferably has a surface resistivity of about 10 $\Omega$ or less. The electroconductive ceramic layer is preferred to be non-magnetic, however, a magnetic electroconductive ceramic layer may be also used in the present invention.

The usual values of the specific electrical resistivity and the Vickers hardness of the typical electroconductive ceramic layer usable in the present invention are shown in the following Table 1.

TABLE 1

| Ceramics | Specific Electric Resistivity ($\mu\Omega \cdot$ cm) | Vickers Hardness (Hv) |
|---|---|---|
| TiC | 53.7 | 2850 |
| WC | 19.8 | 2320 |
| TiN | 24 | 1940 |
| TiCN | 100 | 3000 |
| CrN | 630 | 1160 |
| ZrN | 20.3 | 1380 |
| HfN | 32.9 | 1550 |

As mentioned above, to meet the increasing demand for supplying a low cost and a small-sized apparatus, it has been proposed to use a sleeve-less and/or a shaft-less magnet roll. The present invention may be applicable to either of a sleeve-less magnet roll or a sleeve-less and shaft-less magnet roll. The diameter of the magnet roll is preferably 10 to 50 mm, more preferably 15 to 30 mm for the sleeve-less magnet roll, and preferably 10 to 30 mm, more preferably 10 to 20 mm for a sleeve-less and shaft-less magnet roll. A diameter smaller than the above range results in an unfavorably-reduced surface magnetic flux density, and a diameter larger than the range cannot meet the demand for a smaller size.

In the sleeve-less development, the developer is directly attracted and retained on the surface of the magnet roll by the magnetic attractive force, and transported to the developing zone where the developer is electrically attracted and deposited on the electrostatic latent image on the photosensitive surface to produce a toner image. In this developing method, the image density is largely affected by the arrangement of the magnetic poles on the cylindrical permanent magnet. To avoid the uneven image density, the number of the magnetic poles which face against the photosensitive surface in the developing zone should be increased. More specifically, a smaller inter-pole pitch, a relatively high peripheral speed of the magnet roll as compared with the peripheral speed of the photosensitive surface, or a countermovement in the developing zone of the photosensitive surface and the magnet roll is effective. To meet the above requirement, the number of the magnetic pole is preferable to satisfy the expression: $N \geqq (V_1/V_2)\times\pi D/6$, wherein N is the number of the magnetic pole (even number), $V_1$ is the peripheral speed of the photosensitive surface (mm/s), $V_2$ is the peripheral speed of the magnet roll (mm/s), and D is the outer diameter of the magnet roll (mm).

On the surface of the cylindrical permanent magnet, a plurality of magnetic poles which extend along the axis there of is provided at nearly equal circumferential distances. The inter-pole pitch (distance between two adjacent magnetic poles of different polarities along the circumference) is preferably 0.5 to 10 mm, more preferably 1.5 to 4 mm. An inter-pole pitch shorter than 0.5 mm is not practicable, and makes the surface magnetic flux density unduly reduced to decrease the amount of the magnetic developer retained on the magnet roll, this causing the background fogging and deteriorating the developability. An inter-pole pitch exceeding 10 mm requires a high rotation speed of the magnet roll to obtain an acceptable development result, and also requires the magnet roll and the shaft to be produce with a great precision. In addition, the thickness of the developer layer on a magnetic roll and the thickness between the adjacent magnetic poles are so different that the uneven image density is likely to occur.

The surface magnetic flux density between two adjacent magnetic poles is preferably 100 to 800 G, preferably 200 to 600 G. If the surface magnetic flux density is lower than 100 G, the magnetic developer is weakly retained on the magnet roll to be easily scattered. If exceeding 800 G, the magnetic toner is retained on the magnet roll so strongly that the magnetic toner is difficult to be attracted to the latent image on the photosensitive surface. Further, the magnetic developer layer on the magnet roll is so thick that a driving torque of the magnet roll becomes larger. The thick developer layer also requires a broader developing gas, this making it difficult to attain a strong developing magnetic field.

The magnet roll described above may be produced following a method known in the art. For example, a starting materiel containing a powder of ferrite, such as $MO \cdot nFe_2O_3$ wherein M is at least one of Ba, Sr and Pb and n is a number of 5 to 6, is subjected to a rubber press, extrusion, etc. with or without applying a magnetic field to prepare a cylindrical compact. The cylindrical compact is sintered at 800 to 1300° C. for 1 to 5 hours, and machined to a desired length according to the size of paper to be used to obtain a cylindrical sintered magnet. Then an electroconductive shaft made of a metal material such as a steel (SUM), an austenitic stainless steel (SUS303,SUS304), etc. is inserted and fixed to the cylindrical sintered magnet with or without using an adhesive, and thereafter, the outer surface is circumferentially ground with the shaft as the rotating axis. The ground surface may be provided with a desired roughness by selecting the grinding wheel of a suitable roughness. Before fitting the shaft, the outer surface of the cylindrical permanent magnet may be subjected to a center-less grinding. Next, the electroconductive ceramic layer is formed on the surface of the cylindrical permanent magnet as mentioned above. Before or after forming the electroconductive ceramic layer, the cylindrical permanent magnet is magnetized to have a suitable inter-pole pitch and a surface magnetic flux density.

A shaft-less magnet roll is produced in the same manner as above except for omitting the shaft-fitting step. Both the end surfaces of the cylindrical permanent magnet may be machined to provide shaft portions which project outwards coaxially with the circumferential surface of the cylindrical permanent magnet.

In the developing method of the present invention, a one-component developer comprising a magnetic toner, a two-component developer comprising a magnetic toner and a magnetic carrier (toner concentration: 10 to 90 weight %) and a two-component developer comprising a non-magnetic toner and a magnetic carrier (toner concentration: 5 to 70 weight %) may be used. As compared with the known developing methods, the developing method of the present invention enables to use a broader toner concentration range, because the magnetic developer is attracted directly on the magnet roll and transported to the developing zone while retained thereon. Thus, the developer and the magnet roll move together and do not move relatively to each other. This movement effectively prevents the toner scattering. Therefore, there is no need in the present invention to precisely control the toner concentration.

To assure an efficient transfer of the toner, the toner is preferred to be electrically insulating and has a specific volume resistivity of $10^{14}$ Ω·cm or more. The toner is further preferred to readily acquire a triboelectric charge of 10 μC/g or more, preferably 15 to 60 μC/g, each in terms of absolute value, by the friction with the carrier and the doctor blade. The volume average particle size of the toner is preferably 5 to 10 μm in view of producing a highly fine and detailed image.

The specific volume resistivity of the carrier is preferably $10^3$ to $10^{13}$ Ω·cm. If less than $10^3$ Ω·cm, the carrier is likely to be adhered to the photosensitive drum, and the image density is disadvantageously reduced when exceeding $10^{13}$ Ω·cm. The saturation magnetization ($\sigma_s$) is preferred to be more than 20 emu/g, because the carrier is adhered to the photosensitive drum when lower than the above range. The weight average particle size of the carrier is preferably 10 to 50 μm.

The magnetization was measured by using a vibrating magnetometer (VSM-3 manufactured by Toei Kogyo K.K.). The volume average particle size of the toner was measured by a particle size analyzer (Coulter Counter Model TA-II manufactured by Coulter Electronics Co.). The weight average particle size of the carrier was calculated from the particle size distribution obtained by a vibration sieve method (JIS H 2601).

The specific volume resistivity was determined from electric resistance measured on the carrier or toner charged into a TEFLON® (trade name), polytetrafluoroethylene, cylinder having an inner diameter of 3.05 mm and exposed to an electric field of D.C. 100 V/cm for the magnetic carrier or D.C. 4000 V/cm for the toner under a load of about 0.1 kgf, by using an insulation resistance tester (4329A type tester manufactured by Yokogawa-Hewlett-Packard, Ltd.). The triboelectric charge was determined as follows. A magnetic developer (toner content of 5 weight %) consisting of a toner being measured and a ferrite carrier (KBN-100 manufactured by Hitachi Metals, Ltd.) was mixed well, and blown at a blowing pressure of 1.0 kgf/cm$^2$. The amount of the triboelectric charge of the toner thus treated was measured by using an electric charge measuring apparatus (TB-200 manufactured by Toshiba Chemical Co. Ltd.).

The developing method of the present invention will be described below.

Figure 1:
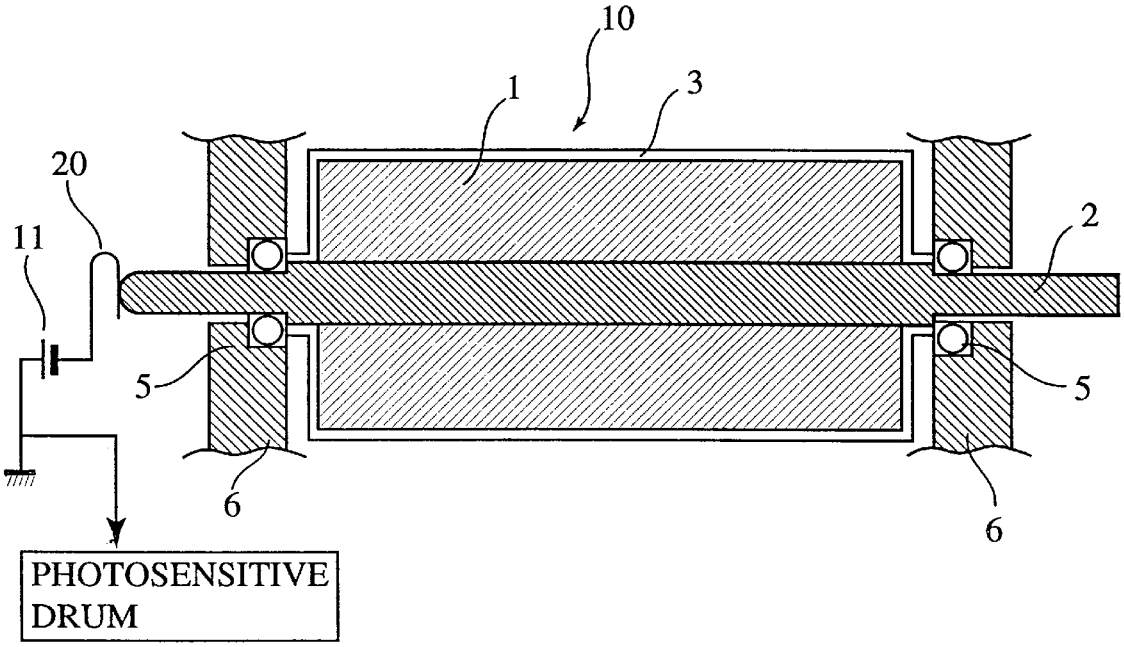
FIG. 1 is a cross sectional view showing a magnet roll of the present invention, taken along an axis of the magnet roll.
Figure 2:
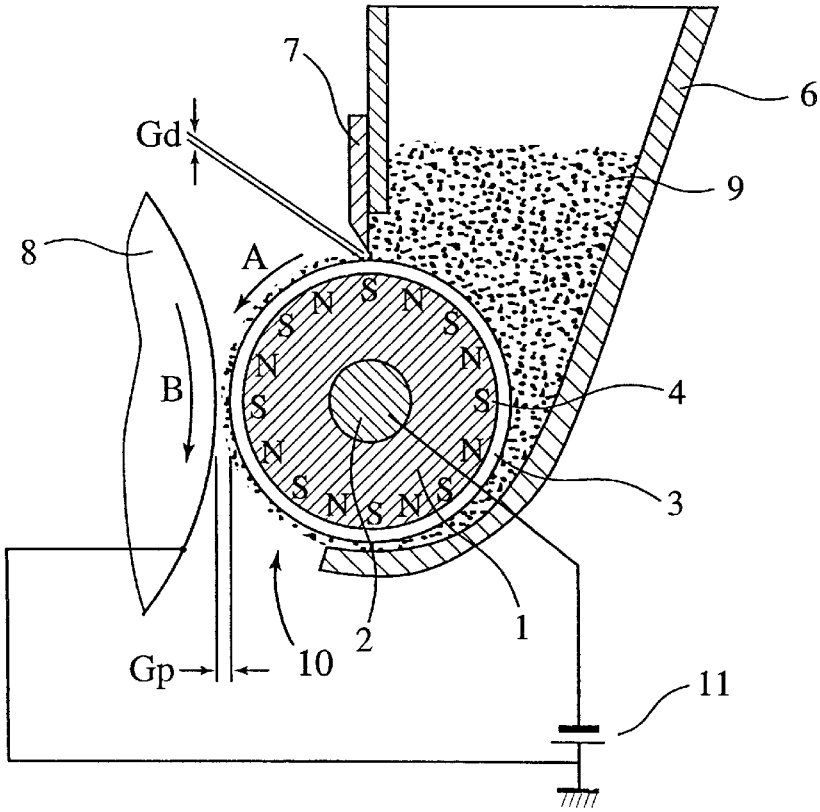
FIG. 2 is a schematic cross sectional view showing a developing device using a magnet roll of the present invention.
Figure 3:
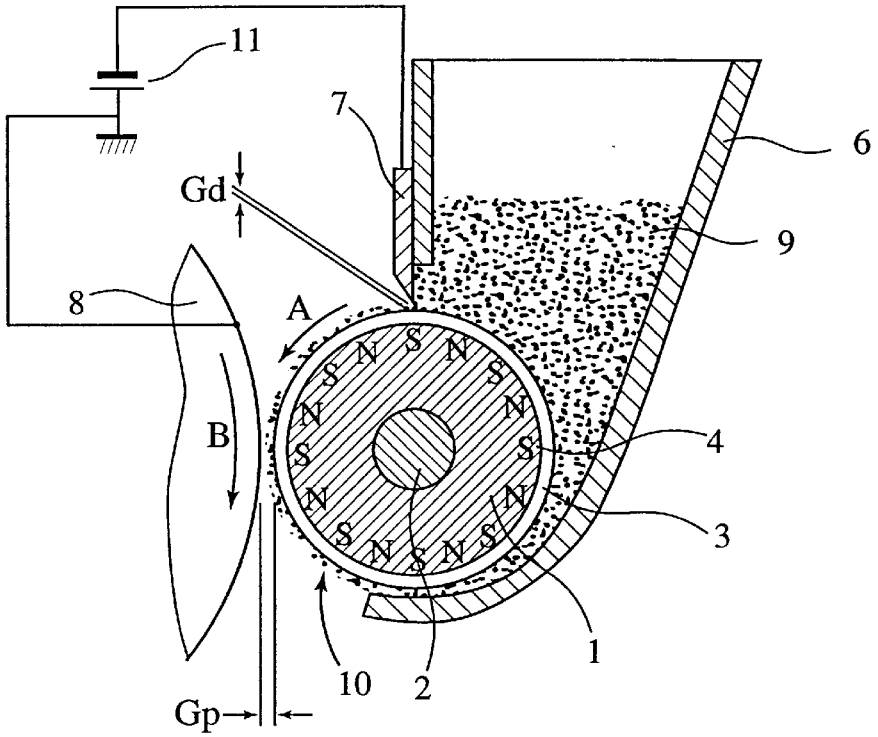
FIG. 3 is a schematic cross sectional view showing another developing device using a magnet roll of the present invention.
Figure 4:
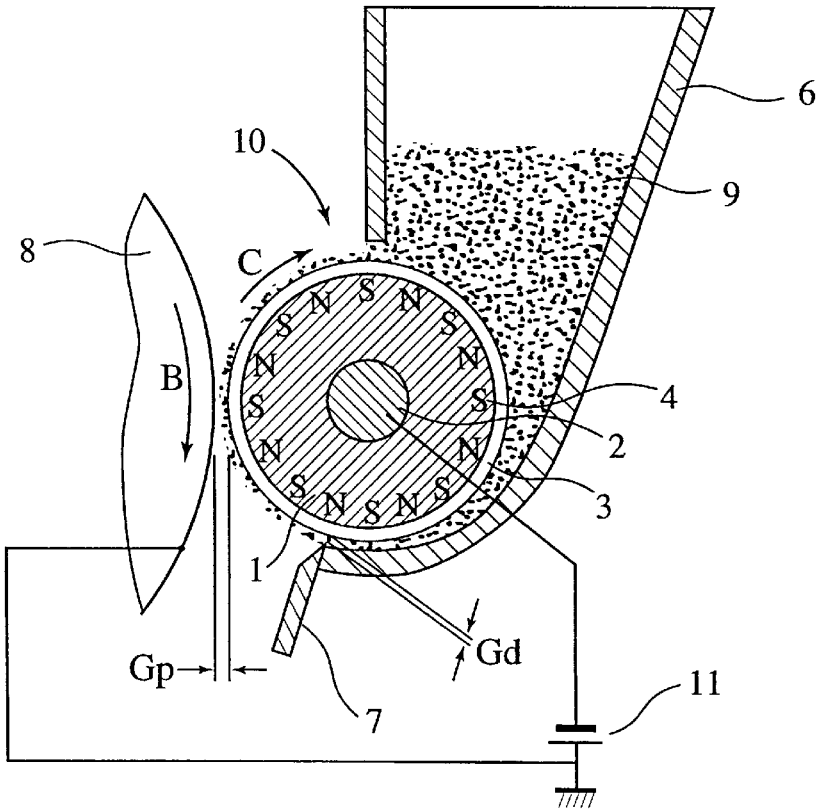
FIG. 4 is a schematic cross sectional view showing still another developing device using a magnet roll of the present invention.

FIG. 1 is a cross sectional view showing a magnet roll 10 of the present invention, and FIGS. 2 to 4 are schematic cross sectional view illustrating several developing methods of the present invention, in which the like reference numerals indicate like parts.

Referring to FIG. 1, a surface of a cylindrical permanent magnet 1 is coated with an electroconductive ceramic layer 3 which partially covers an electroconductive shaft 2. The electroconductive ceramic layer 3 may be separately formed on the cylindrical permanent magnet and the shaft, and then both the electroconductive ceramic layers are electrically interconnected. The magnet roll 10 is rotatably supported by a wall of a developer container 6 via each bearing 5. One terminal of a power source 11 is connected to one of the end surface of the shaft 2 through a contact electrode 20, and the other terminal is connected to a photosensitive drum to apply a bias voltage to a developing gap Gp as is also shown in FIGS. 2 and 4. With such a construction, a bias voltage can be effectively applied to the developing gap Gp while minimizing a voltage drop of the bias even when the cylindrical permanent magnet 1 is made of a material of a high electric resistivity or an electrically insulating material such as sintered ferrite, etc. In FIG. 3, another biasing method is described. The electroconductive ceramic layer is electrically connected to the terminal of the power source 11 through an electroconductive doctor blade 7 contacting with a magnetic developer 9 magnetically retained on the surface of the magnet roll 10. The bias may be a D.C. bias, an A.C. bias or a D.C./A.C. superimposed bias. The peak-to-peak voltage ($V_{pp}$) of the A.C. bias voltage is preferably 800 to 2500 V, and the frequency of the A.C. bias is preferably 800 to 2500 Hz. The D.C. bias voltage is preferably 80 to 250 V (absolute value) for the normal development. In the reverse development, the D.C. bias voltage is preferably 0.6 to 0.9 times the potential of the photosensitive surface, and usually 400 to 600 V (absolute value).

In a with-development where the magnet roll 10 (and the developer 9 retained thereon) and the photosensitive drum 8 move in the same direction in the developing zone as is shown in FIGS. 2 and 3 by arrows A and B, the peripheral speed ($V_1$, mm/s) of the photosensitive drum 8 and the peripheral speed ($V_2$, mm/s) of the magnet roll are preferred to satisfy the relation: $1 \leqq V_2/V_1 \leqq 5$. When the ratio of $V_2/V_1$ exceeds 5, the system is greatly noisy due to an increased driving torque of the magnet roll, the magnet developer is scattered, or the carrier is abraded to a large extent. When the ratio is lower than 1, the electrostatic latent image is not developed uniformly by the developer retained on magnetic poles 4 and the developer between the adjacent poles, or a sufficient amount of the magnetic developer is not transported to the developing zone to result in uneven image density. In the with-development, the doctor gap Gd is preferably 0.2 to 0.4 mm, and the developing gap Gp may be nearly the same as the doctor gap Gd.

In a counter-development where the magnet roll 10 (and the developer 9 retained thereon) and the photosensitive drum 8 move in the opposite directions in the developing zone as is shown in FIG. 4 by arrows B and C, the $V_1$ and $V_2$ are preferred to also satisfy the relation: $1 \leqq V_2/V_1 \leqq 5$. The doctor blade Gd is preferably 0.2 to 0.4 mm and the developing gap Gp is Gd+0.1 mm.

The present invention will be further described while referring to the following Examples which should be considered to illustrate various preferred embodiments of the present invention.

EXAMPLE 1

A shaft (10 mm diameter) made of SUM-22 having a Ni plating surface was inserted and fitted by an epoxy resin adhesive in a hollow cylindrical sintered ferrite magnet (YBM-3 manufactured by Hitachi Metals. Ltd., outer diameter: 21 mm, inner diameter: 10.5 mm, length: 220 mm) produced by hydrostatically pressing a dry-blended material comprising a Ba-ferrite powder having an average particle size of 1 μm and a PVA binder resin. After grinding the surface of the cylindrical magnet to an outer diameter of 20 mm, a CrN electroconductive ceramic layer of about 2 μm thick was formed on the surface of the cylindrical magnet and on a part of the surface of the shaft continuously by ion plating method. Then, the cylindrical magnet was magnetized to obtain a magnet roll having symmetric 32 poles and a surface magnetic flux density of 300 G. The CrN electroconductive ceramic layer had a surface resistivity of 0.51 Ω and a Vickers hardness Hv (20° C.) of 980.

The surface resistivity was determined as follows. Two ring electrodes were attached by an electroconductive adhesive tape on the surface of the magnet roll with a distance of 1 cm in the axial direction. Then a D.C. voltage was applied between the electrodes to measure the current flowing through the electroconductive ceramic layer between two electrodes. The surface resistivity was calculated from the results.

A toner was produced by melt-kneading a dry-blended material consisting of 55 weight parts of styrene-n-butyl methacrylate copolymer (Mw was about 210,000 and Mn was about 16,000), 40 weight parts of magnetite (EPT-500 manufactured by Toda Kogyo K.K.), 3 weight parts of polypropylene (TP-32 manufactured by Sanyo Chemical Industries, Ltd.), and 2 weight parts of a charge-controlling agent (Bontron S34 manufactured by Orient Chemical K.K.), cooling to solidify the kneaded mixture, pulverizing and classify the cooled product to produce a powder. The 100 parts by weight of the powder thus obtained was added with 0.5 part by weight of a hydrophobic silica (flowability improver, Aerosil R972 manufactured by Nippon Aerosil Co.) to obtain the toner having an average particle size about 8 μm, a triboelectric charge of −18 μC/g and a specific volume resistivity of $3.5 \times 10^{14}$ Ω·cm. The toner thus produced was blended with a flat iron carrier coated with a silicone resin (average particle size was 30 μm, saturation magnetization σs was 200 emu/g, and specific volume resistivity was $10^9$ Ω·cm) to prepare a magnetic developer having a toner concentration of 50 weight %.

By using the above magnet roll and the magnetic developer, a reverse developing test (with-development) was conducted as shown in FIG. 2 under the following conditions.

Photosensitive drum:
- organic photoconductor
- surface potential: −600 V (non-irradiated area)
- peripheral speed ($V_1$): 25 mm/s Magnet roll:
- symmetric 32 poles
- surface magnetic flux density: 300 G
- outer diameter: 20 mm
- peripheral speed ($V_2$): 62.5 mm/s Developing gap: 0.4 mm Doctor gap: 0.35 mm Bias voltage: −550 V (D.C.) applied to the shaft Transfer: corona transfer to A4 size paper Fixing: heat roll (180° C., 1 kgf/cm line pressure)

As a result, a good image of high image density with less background fogging was produced. Also no blur was observed in the image and fine lines were reproduced without variation in the line width. After 100,000 continuous developing operation, it was confirmed that there was little change in the image density and that no abnormal change was detected on the electroconductive ceramic layer.

COMPARATIVE EXAMPLE 1

In the same manner as in Example 1 except for using a magnet roll having no electroconductive ceramic layer, the developing test was conducted. The produced image was apparently poor in the image quality.

EXAMPLE 2

In the same manner as in Example 1 except for using a magnet roll having symmetric 18 poles and a surface magnetic flux density of 500 G, the developing test was conducted. As a result, a good image of high image density with less background fogging was produced. Also no blur was observed in the image and fine lines were reproduced without variation in the line width. After 100,000 continuous developing operation, it was confirmed that there was little change in the image density and that no abnormal change was detected on the electroconductive ceramic layer.

COMPARATIVE EXAMPLE 2

In the same manner as in Example 1 except for using a magnet roll having symmetric 6 poles and a surface magnetic flux density of 750 G, the developing test was conducted. Since the inter-pole pitch was larger than 10 mm, an image of poor quality was produced.

COMPARATIVE EXAMPLE 3

In the same manner as in Example 1 except for using a magnet roll having symmetric 4 poles and a surface magnetic flux density of 800 G, the same developing test was conducted. Since the inter-pole pitch was larger than 10 mm and the number of the magnetic poles did not satisfy the requirement: $N \geqq (V_1/V_2) \times \pi D/6$, an image of poor quality was produced.

EXAMPLE 3

A shaft (10 mm diameter) made of SUM-22 having a Ni plating surface was inserted and fitted by an epoxy resin adhesive in a hollow cylindrical sintered ferrite magnet (YBM-3 manufactured by Hitachi Metals. Ltd., outer diameter: 21 mm, inner diameter: 10.5 mm, length: 220 mm). After grinding the surface of the cylindrical magnet to an outer diameter of 20 mm, a TiN electroconductive ceramic layer of about 2 $\mu$m thick was formed on the surface of the cylindrical magnet and on a part of the surface of the shaft continuously by ion plating method. Then, the cylindrical magnet was magnetized to obtain a magnet roll having symmetric 32 poles and a surface magnetic flux density of 300 G. The TiN electroconductive ceramic layer had a surface resistivity of 0.25 Ω and a Vickers hardness Hv (20° C.) of 1500.

By using the above magnet roll and the magnetic developer of Example 1, a reverse developing test (with-development) was conducted in the same manner as in Example 1 except for changing the peripheral speed ($V_1$) of the photosensitive drum to 56.25 mm/s. As a result, a good image of high image density with less background fogging was produced. Also no blur was observed in the image and fine lines were reproduced without variation in the line width. After 100,000 continuous developing operation, it was confirmed that there was little change in the image density and that no abnormal change was detected on the electroconductive ceramic layer.

EXAMPLE 4

In the same manner as in Example 3 except for using a magnet roll having symmetric 18 poles and a surface magnetic flux density of 500 G, the developing test was conducted. As a result, a good image of high image density with less background fogging was produced. Also no blur was observed in the image and fine lines were reproduced without variation in the line width. After 100,000 continuous developing operation, it was confirmed that there was little change in the image density and that no abnormal change was detected on the electroconductive ceramic layer.

EXAMPLE 5

In the same manner as in Example 3 except for using a magnet roll having symmetric 10 poles and a surface magnetic flux density of 600 G, the developing test was conducted. As a result, a good image of high image density with less background fogging was produced. Also no blur was observed in the image and fine lines were reproduced without variation in the line width. After 100,000 continuous developing operation, it was confirmed that there was little change in the image density and that no abnormal change was detected on the electroconductive ceramic layer.

COMPARATIVE EXAMPLE 4

In the same manner as in Example 3 except for using a magnet roll having symmetric 8 poles and a surface magnetic flux density of 700 G, the developing test was conducted. Since the number of the magnetic poles did not satisfy the requirement: $N \geqq (V_1/V_2) \times \pi D/6$, an image of poor quality was produced.

EXAMPLE 6

A shaft (10 mm diameter) made of SUM-22 having a Ni plating surface was inserted and fitted by an epoxy resin adhesive in a hollow cylindrical sintered ferrite magnet (YBM-3 manufactured by Hitachi Metals. Ltd., outer diameter: 21 mm, inner diameter: 10.5 mm, length: 220 mm). After grinding the surface of the cylindrical magnet to an outer diameter of 20 mm, a TiCN electroconductive ceramic layer of about 2 $\mu$m thick was formed on the surface of the cylindrical magnet and on a part of the surface of the shaft continuously by ion plating method. Then, the cylindrical magnet was magnetized to obtain a magnet roll having symmetric 32 poles and a surface magnetic flux density of 300 G. The TiCN electroconductive ceramic layer had a surface resistivity of 0.11 Ω and a Vickers hardness Hv (20° C.) of 2400.

By using the above magnet roll and the magnetic developer of Example 1, a reverse developing test (counter-development) as shown in FIG. 4 was conducted in the same manner as in Example 1 except for changing the peripheral speed ($V_2$) of the magnet roll to 112.6 mm/s. As a result, a good image of high image density with less background fogging was produced. Also no blur was observed in the image and fine lines were reproduced without variation in the line width. After 100,000 continuous developing operation, it was confirmed that there was little change in the image density and that no abnormal change was detected on the electroconductive ceramic layer.

EXAMPLE 7

In the same manner as in Example 6 except for using a magnet roll having symmetric 18 poles and a surface magnetic flux density of 500 G, the developing test was conducted. As a result, a good image of high image density with less background fogging was produced. Also no blur was observed in the image and fine lines were reproduced without variation in the line width. After 100,000 continuous developing operation, it was confirmed that there was little change in the image density and that no abnormal change was detected on the electroconductive ceramic layer.

COMPARATIVE EXAMPLE 5

In the same manner as in Example 6 except for using a magnet roll having symmetric 4 poles and a surface magnetic flux density of 800 G, the developing test was conducted. Since the inter-pole pitch was larger than 10 mm, an image of poor quality was produced.

TABLE 2

| No. | N | $V_1$ (mm/s) | $V_2$ (mm/s) | D (mm) | Pitch (mm) | Image Density | Background Fogging Density |
|---|---|---|---|---|---|---|---|
| Examples | | | | | | | |
| 1 | 32 | 25 | 62.5 | 20 | 2.0 | 1.39 | 0.09 |
| 2 | 18 | 25 | 62.5 | 20 | 3.5 | 1.35 | 0.08 |

TABLE 2-continued

| No. | N | $V_1$ (mm/s) | $V_2$ (mm/s) | D (mm) | Pitch (mm) | Image Density | Background Fogging Density |
|---|---|---|---|---|---|---|---|
| 3 | 32 | 56.25 | 62.5 | 20 | 2.0 | 1.40 | 0.08 |
| 4 | 18 | 56.25 | 62.5 | 20 | 3.5 | 1.35 | 0.09 |
| 5 | 10 | 56.25 | 62.5 | 20 | 6.3 | 1.35 | 0.10 |
| 6 | 32 | 25 | 112.6 | 20 | 2.0 | 1.38 | 0.07 |
| 7 | 18 | 25 | 112.6 | 20 | 3.5 | 1.35 | 0.09 |
| Comparative Examples | | | | | | | |
| 1 | 32 | 25 | 62.5 | 20 | 2.0 | 1.20 | 0.10 |
| 2 | 6 | 25 | 62.5 | 20 | 10.5 | 1.15 | 0.10 |
| 3 | 4 | 25 | 62.5 | 20 | 15.7 | 0.9 | 0.25 |
| 4 | 8 | 56.25 | 62.5 | 20 | 7.9 | 0.8 | 0.25 |
| 5 | 4 | 25 | 112.6 | 20 | 15.7 | 1.15 | 0.10 |

What is claimed is:

1. A magnet roll comprising:

a cylindrical permanent magnet having a surface thereon;

a plurality of magnetic poles which extend along an axis of said magnet roll; and an electroconductive ceramic layer formed at least on a circumferential surface of said cylindrical permanent magnet, wherein a thickness of said electroconductive ceramic layer is 5 $\mu$m or less.

2. The magnet roll according to claim 1, wherein said electroconductive ceramic layer is a ceramic selected from the group consisting of TiC, WC, TiN, TiCN, CrN, ZrH, HfN, Ti+TiN, and Cr+CrN.

3. The magnet roll according to claim 1, wherein said electroconductive ceramic layer has a specific resistivity of $1\times10^3$ Ω·cm or less.

4. The magnet roll according to claim 1, wherein said electroconductive ceramic layer has a Vickers hardness of 400 to 3500.

5. The magnet roll according to claim 1, wherein said cylindrical permanent magnet is a sintered ferrite magnet.

6. A method of developing an electrostatic latent image, comprising:

electrostatically charging a surface of a rotating cylindrical photosensitive drum to a uniform potential;

exposing the electrostatically charged portion of said photosensitive drum to a light image of original informational data being reproduced to form an electrostatic latent image corresponding to said original informational data;

transporting a magnetic developer containing an electrically insulating toner to a developing zone defined by a gap between said photosensitive drum and a sleeve-less magnet roll comprising a cylindrical permanent magnet having on a surface thereof a plurality of magnetic poles which extend along an axis of said magnet roll and are circumferentially arranged at nearly equal distances and an electroconductive ceramic layer formed at least on a circumferential surface of said cylindrical permanent magnet, said magnetic developer being attracted on the surface of said sleeve-less magnet roll and transported to said developing zone by a rotation of said sleeve-less magnet roll;

developing said latent image by said magnetic developer in said developing zone to form a toner image on said photosensitive drum while applying a bias voltage to said developing zone;

the number of said magnetic poles (N) satisfying the following relation:

$$N \geq (V_1/V_2)\times\pi D/6$$

wherein $V_1$ is a peripheral speed (mm/s) of said photosensitive drum, $V_2$ is a peripheral speed of said magnet roll and D is an outer diameter (mm) of said magnet roll, wherein a thickness of said electroconductive ceramic layer is 5 $\mu$m or less.

7. The developing method according to claim 6, wherein said bias voltage is produced by using said electroconductive ceramic layer as an electrode.

8. The developing method according to claim 6, wherein said bias voltage is produced by using as an electrode a doctor blade contacting with said magnetic developer magnetically retained on said magnet roll.

9. The developing method according to claim 6, wherein said electroconductive ceramic layer is a ceramic selected from the group consisting of TiC, WC, TiN, TiCN, CrN, ZrN, HfN, Ti+TiN, and Cr+CrN.

10. The developing method according to claim 6, wherein said electroconductive ceramic layer has a specific electric resistivity of $1\times10^3$ Ω·cm or less.

11. The developing method according to claim 6, wherein said electroconductive ceramic layer has a Vickers hardness of 400 to 3500.

12. The developing method according to claim 6, wherein said cylindrical permanent magnet is a sintered ferrite magnet.

13. The developing method according to claim 6, wherein an inter-pole pitch of said magnetic poles is 0.5 to 10 mm.

* * * * *